US006140754A

United States Patent [19]

Ko

[11] Patent Number: 6,140,754

[45] Date of Patent: Oct. 31, 2000

[54] STRUCTURE OF SHADOW MASK FOR FLAT CATHODE RAY TUBE

[75] Inventor: Sung-Woo Ko, Kumi, Rep. of Korea

[73] Assignee: LG Electronics, Inc., Seoul, Rep. of Korea

[21] Appl. No.: 09/119,962

[22] Filed: Jul. 21, 1998

[30] Foreign Application Priority Data

Jul. 23, 1997 [KR] Rep. of Korea ..... 97-34359

[51] Int. Cl.[7] ..... H01J 29/07; H01J 29/81

[52] U.S. Cl. ..... 313/407; 313/402; 313/403

[58] Field of Search ..... 313/402, 403, 313/407

[56] References Cited

U.S. PATENT DOCUMENTS 3,894,321 7/1975 Moore ..... 313/402

4,652,791 3/1987 Palac et al. ..... 313/402

4,767,962 8/1988 Adler et al. ..... 313/402

*Primary Examiner*—Michael H. Day

*Attorney, Agent, or Firm*—Birch Stewart Kolasch & Birch, LLP

[57] ABSTRACT

A shadow mask for a flat CRT includes: an effective face in a central region having apertures through which electron beams emitted from an electron gun pass; a rail fixed to the mask, extending around the effective face; and ineffective faces outside the rail where mask holes are formed; wherein at least some of the mask holes formed in the ineffective faces of the mask are shaped as substantially circular dots, and decrease in diameter from the central region toward the outside of edges of the mask.

3 Claims, 5 Drawing Sheets

STRUCTURE OF SHADOW MASK FOR FLAT CATHODE RAY TUBE

BACKGROUND OF THE INVENTION

1. Field of the Invention

The present invention relates to a flat color cathode ray tube (hereinafter referred to as "CRT"). More particularly, it relates to a shadow mask for a flat CRT having a construction which prevents an electron beam from mislanding when kinetic energy of the electrons is converted into heat when colliding with the shadow mask causing the mask expand during operation of the CRT.

2. Discussion of Related Art

As shown in FIGS. 1 and 2, a conventional flat CRT comprises a safety glass lens 1 bonded to the front of a flat panel 2 with a resin in order to maintain an explosion-proof characteristic; a funnel 3 attached to panel 2 by a glass frit; an electron gun 5 within the neck 3*a* of funnel 3 for emitting R, G, and B electron beams 4; a flat tension mask 7 behind panel 2 and having multiple slit-shaped apertures for selecting the color of the electron beam; and a rail 6 for securing the mask 7 at regular intervals from t-he panel 2.

The mask 7 has an effective face 10 on the center, in which apertures are formed to select the colors of electron beams; and ineffective faces 12 and 13 around the effective face 10, where apertures for stretching the mask are formed, and not formed, respectively. Alignment holes "a" are formed on the respective, ineffective faces 12.

The electron beams 4, emitted from the electron gun 5, pass through electron beam apertures 7' in the shadow mask 7, before colliding with a phosphor screen (not shown) applied to the inner surface of the panel 2. Kinetic energy of the electron beams 4 causes multiple phosphors to emit light so that an image is displayed on the panel 2. Only 20% of the electrons pass through the electron beam apertures 7' of the shadow mask 7, the rest collide with shadow mask 7, and then are converted into heat so that the shadow mask 7 expands from the heat. Such a phenomenon is called "doming".

The position where the electron beams land on the phosphor screen is changed by the doming phenomenon, and therefore degradation of color purity is caused. In order to solve this problem, the tension mask 7 to which tension is applied, compensates for expansion due to heat caused by electrons colliding against the mask.

The alignment holes "a" of tension mask 7 are fiducial holes for allowing a machine for mask stretching to be in accord with alignment of the mask. If the mask has very inaccurate alignment with respect to the machine, the rate of deformation applied to the mask varies with every position of the mask. Therefore, not only the above-mentioned doming phenomenon occurs during operation of the CRT, but the rate of deformation applied to the mask at the time of stretching the mask is abruptly changed. In this connection, the mask is susceptible to breakage. In addition, the alignment holes "a" can be positioned at every place of the ineffective face of the mask, which remarkably alters characteristics of substance. Thus, a central part has advantages over corners where stress is concentrated.

Referring to the structure of the ineffective face 12 of the mask, as shown in FIG. 3, slot-shaped holes are formed on the ineffective face, and treated with tie-bar grading that interval "v" between holes gradually increases from the center to the edge of the of mask, in order to prevent the mask from breaking when various rate of deformation are applied to boundaries between the ineffective face 12 where mask holes are formed and the ineffective face 13 where mask holes are not formed, and to make it easier to weld the stretched mask and a frame.

Characteristically, the slot-shaped holes of the ineffective face have a longitudinal, effective modulus of elasticity much larger than the transverse, effective modulus of elasticity. Corners of the mask, where the mask stretching machine is in contact with the mask, may break due to the shear stress in the width wise direction. Moreover, slots are very vulnerable to the shear stress, and in particular, breakage occurs at slot-shaped holes around the alignment holes, which are still larger in size than other holes.

SUMMARY OF THE INVENTION

Accordingly, the present invention is directed to a structure of a shadow mask for a flat CRT that substantially obviates one or more of the problems, limitations, and disadvantages of the related art.

An objective of the present invention is to provide a shadow mask having a construction that disperses the stress concentrated on the outer circumference of the mask, particularly on an ineffective face when the rate of deformation is applied to the mask, to prevent the mask from breaking due to stress concentrations.

Additional features and advantages of the invention will be set forth in the description which follows, and in part will be apparent from the description, or may be learned through practice of the invention. The objectives and other advantages of the invention will be realized and attained by the structure, particularly as detailed in the written description and claims hereof as well as the appended drawings.

To achieve these and other advantages and in accordance with the purpose of the present invention, as embodied and broadly described, the mask holes are shaped as a dot on ineffective face where mask apertures are formed, and are formed with tie-bar grading type holes such that the diameter of dot-shaped holes is gradually reduced from the center to the edge of the mask.

It is to be understood that both the foregoing general description and the following detailed description are exemplary and explanatory, and are intended to provide further explanation of the invention as claimed.

BRIEF DESCRIPTION OF THE ATTACHED DRAWINGS

The accompanying drawings, which are included to provide a further understanding of the invention, and are incorporated in and constitute a part of this specification, illustrate embodiments of the invention that together with the description explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
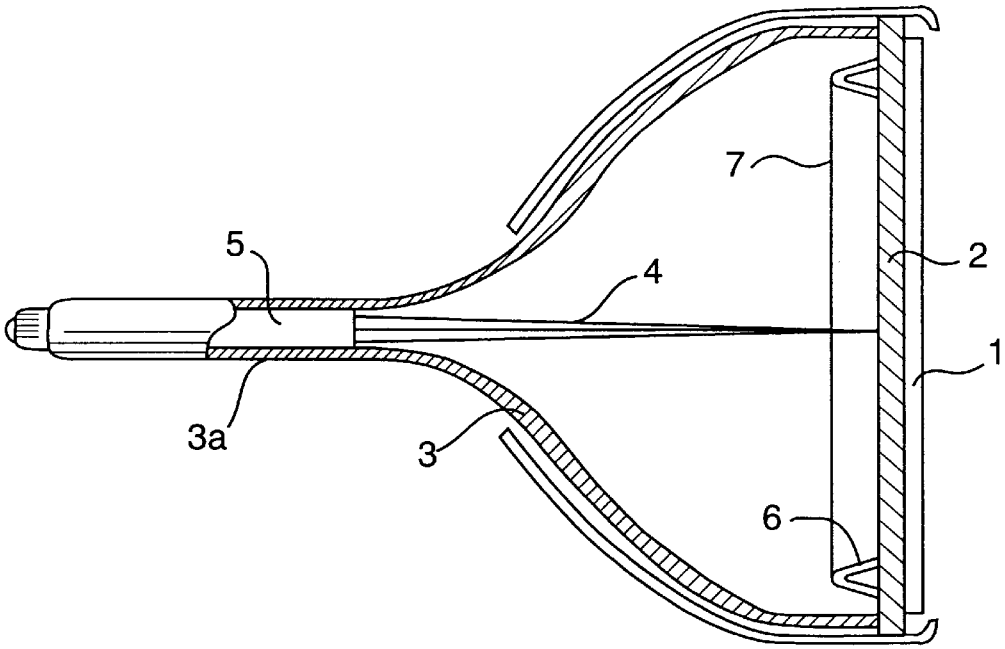
FIG. 1 PRIOR ART
FIG. 1 is a cross-section of a conventional flat CRT.
Figure 2:
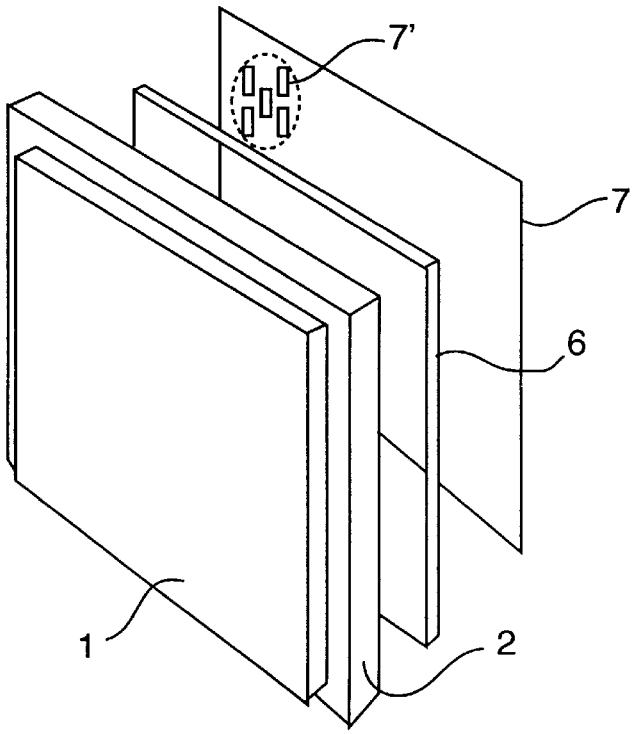
FIG. 2 PRIOR ART
FIG. 2 is an exploded, perspective view of a panel of the flat CRT.
Figure 3B:
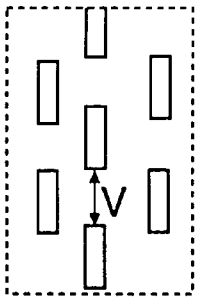
FIG. 3B PRIOR ART
FIG. 3 shows a structure of the conventional mask.
Figure 3A:
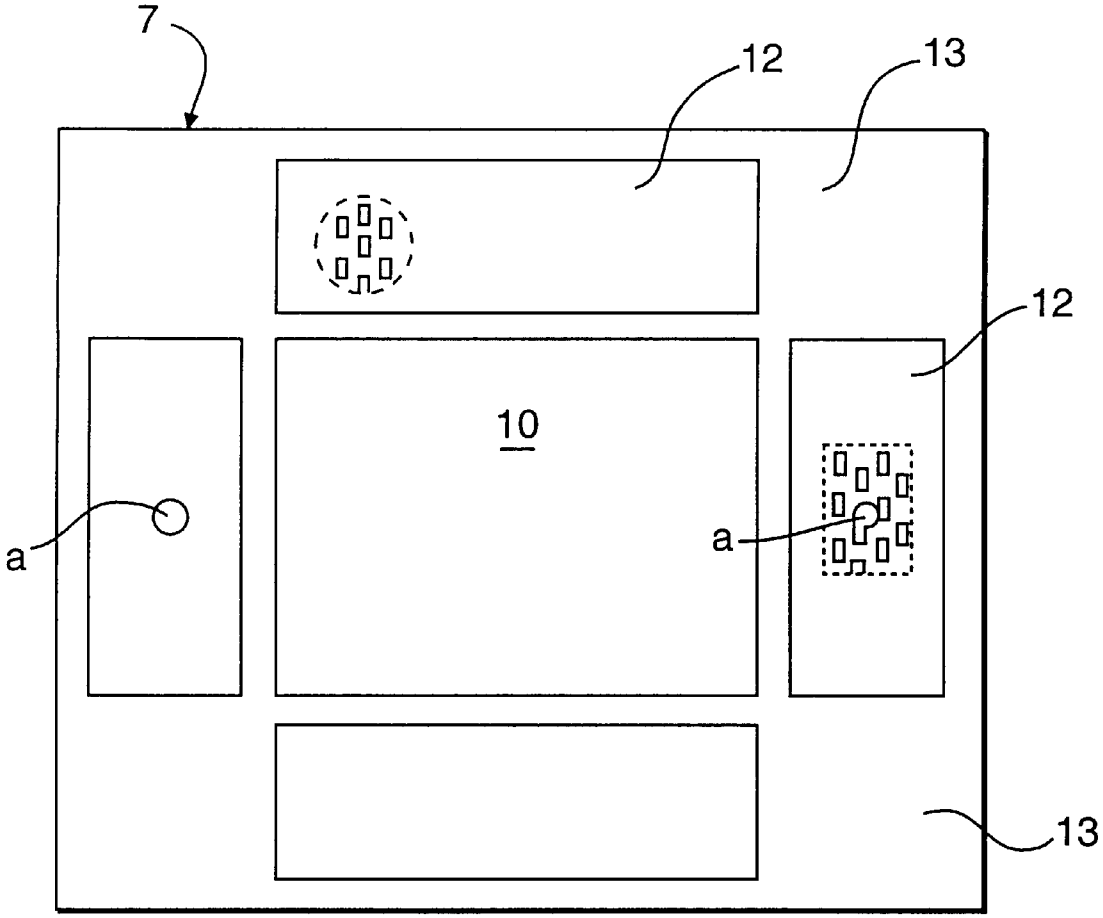
FIG. 3A PRIOR ART
Figure 4:
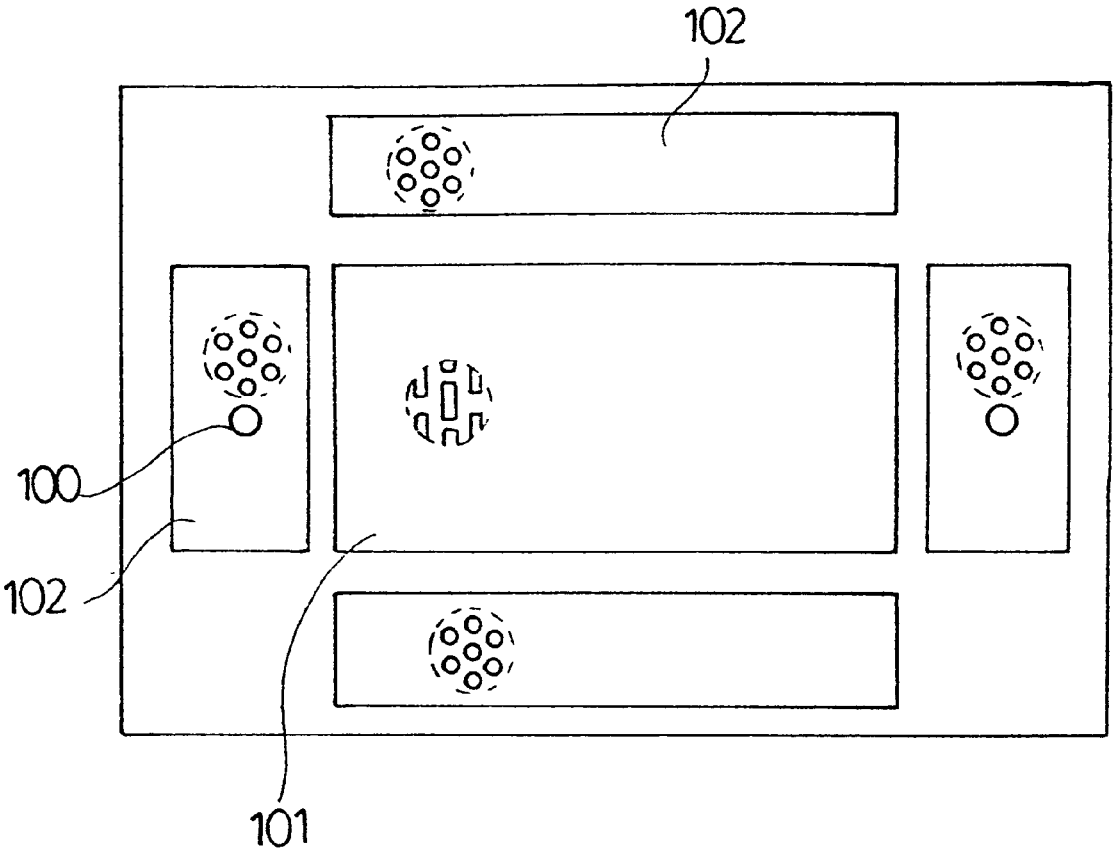
FIG. 4 depicts a preferred embodiment of a mask of the present invention.

As illustrated in FIG. 4, a tension mask according to a preferred embodiment of the present invention, constitutes an effective face 101 in which slot-shaped holes are formed, and ineffective faces 102 adjacent to the effective face 101, in which dot-shaped holes are formed.

Reference numeral 100 is indicative of alignment holes.

The mask with ineffective faces 102 forming dot-shaped holes is prevented from breaking due to the shear stress occurring at its corners in the widthwise direction, when stretched. This is because the mask with slot-shaped holes has a longitudinal modulus of elasticity about three-to-four times as large as transverse the modulus in a direction, in such a way that a larger force is required to stretch the mask in the longitudinal direction, particularly at the edges of the mask.

From the view point of structure, the dot-shaped holes endure the shear deformation in the plane of the mark more than slot-shaped ones.

The mask in which innumerable holes are closely formed, is susceptible to breakage due to shear deformation, not transverse, longitudinal deformation.

The following table lists the respective abilities of the slot-shaped hole and dot-shaped hole, to cope with breakage. Here, the ability of dot-shaped hole is shown relatively to the slot-shaped hole represented as "1".

| | Y-direction | X-direction | Shear |
|---|---|---|---|
| Slot-shaped hole | 1 | 1 | 1 |
| Dot-shaped hole | 0.54 | 3.8 | 7.3 |

X-direction and Y-direction are important factors, but the shear stress has a greater effect upon the breakage of the mask in practical operation. In this connection, the ability of dot-shaped hole with respect to mask breakage by shear stress is about seven times as great as that of a slot-shaped hole. Therefore, it should be noted that dot-shaped holes are formed in an outer circumference, ineffective faces 102, to which relatively high stress is applied.

Furthermore, when the stretching force is applied to substances, where two materials having different modulus of elasticities are coupled with each other on the same plane, in general, the stress is concentrated on the boundary where the modulus of elasticity is changed. That is, the diameter of dot-shaped holes is changed by degrees, to increase or reduce the effective modulus of elasticity of the boundary between the part where holes are formed and the part where holes are not formed, thereby preventing the concentration of stress.

Figure 5:
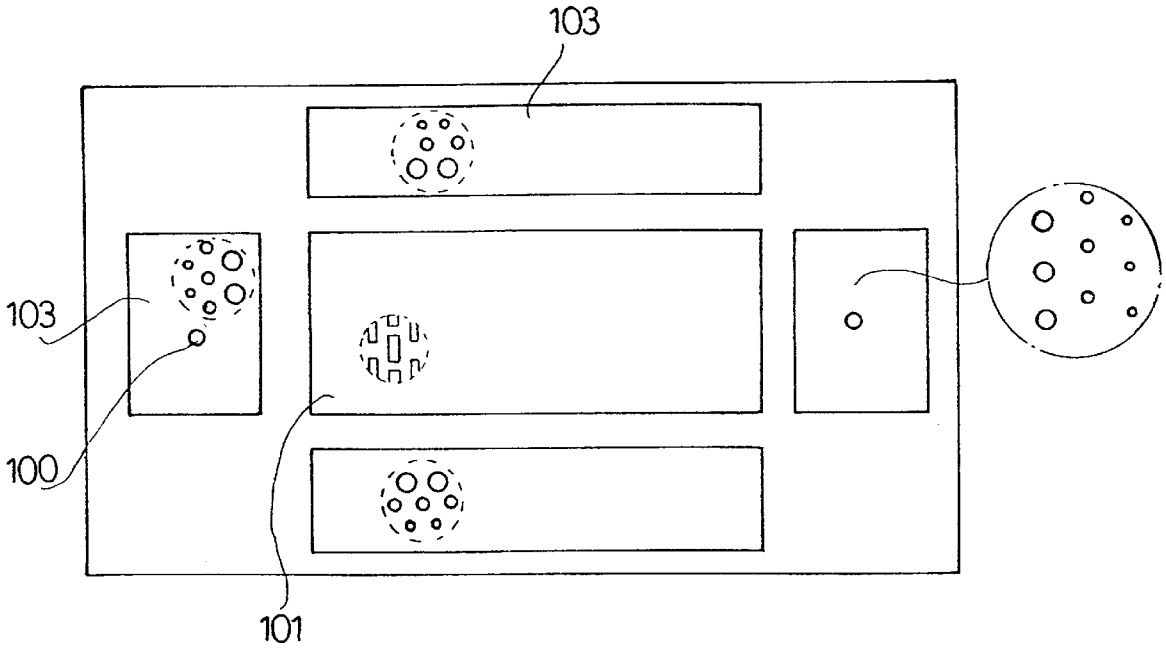
FIG. 5 shows another preferred embodiment of the mask of the present invention.

In another preferred embodiment of the present invention as illustrated in FIG. 5, the dot-shaped holes of ineffective faces 103 decrease in diameter from inside to outside of the mask by way of tie-bar grading so as to prevent the stress concentration.

Figure 6:
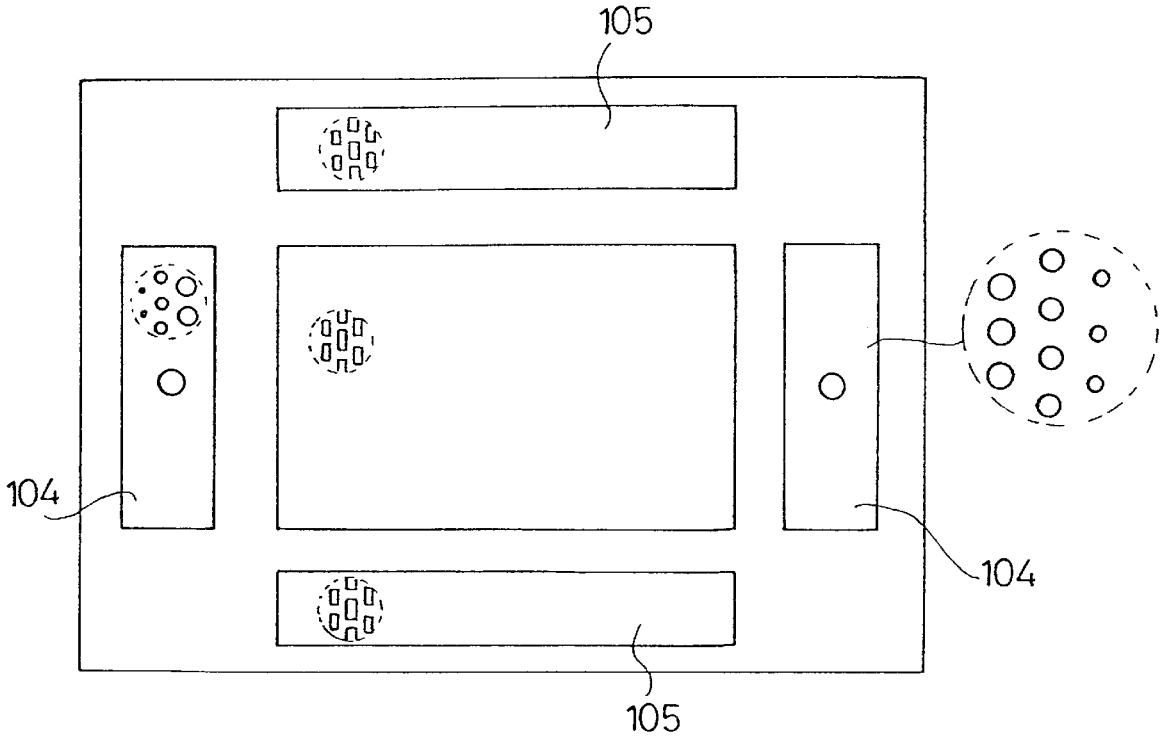
FIG. 6 illustrates still another preferred embodiment of the mask of the present invention.

In still another preferred embodiment of the present invention as depicted in FIG. 6, the holes in ineffective faces formed on both ends 105 of the long sides of mask are shaped as slots, and the dot-shaped holes in ineffective faces formed on both ends 104 of short sides of mask decrease in diameter from inside to outside of the mask, to prevent mask breakage.

As described above, the stress concentrated on the ineffective face is dispersed when the rate of deformation is applied to the flat foil tension mask, so as to prevent the mask from breaking due to stress concentration.

It will be apparent to those skilled in the art that various modifications and variations can be made in a structure of a shadow mask for a flat CRT of the present invention without departing from the spirit or scope of the invention. Thus, it is intended that the present invention cover the modifications and variations of this invention that come within the scope of the appended claims and their equivalents.

What is claimed is:

1. A shadow mask for a flat CRT comprising:

an effective face in a central region, having apertures, through which electron beams emitted from an electron gun pass;

a rail that is fixed to the mask and surrounding the effective face; and ineffective face regions disposed around the rail having mask holes formed therein;

wherein the mask holes formed in selected ones of the ineffective face regions of the mask are shaped as substantially circular dots, the substantially circular dots forming the mask holes decreasing in diameter within the ineffective face regions in directions extending outwardly from said rail toward outer edges of the shadow mask.

2. The shadow mask as claimed in claim 1, wherein the holes in ineffective face regions formed on shorter sides of the mask are shaped as substantially circular dots, and the holes in ineffective face regions formed on longer sides of the mask are shaped as slots.

3. The shadow mask as claimed in claim 1, wherein slot-shaped holes are also formed on the effective face of the mask.

* * * * *